US008528370B2

(12) United States Patent
Yu et al.

(10) Patent No.: US 8,528,370 B2
(45) Date of Patent: Sep. 10, 2013

(54) LOCK

(75) Inventors: Chang-Chiang Yu, Chung-Ho (TW); Chia-Hung Wang, Chung-Ho (TW)

(73) Assignee: Sinoxlock (Kunshan) Co., Ltd., Kunshan, Jiangsu (CN)

( * ) Notice: Subject to any disclaimer, the term of this patent is extended or adjusted under 35 U.S.C. 154(b) by 253 days.

(21) Appl. No.: 12/859,677

(22) Filed: Aug. 19, 2010

(65) Prior Publication Data

US 2011/0041569 A1 Feb. 24, 2011

(30) Foreign Application Priority Data

Aug. 19, 2009 (CN) ..... 2009 1 0166477

(51) Int. Cl.
*E05B 67/06* (2006.01)

(52) U.S. Cl.
USPC ..... 70/14; 70/49; 70/233

(58) Field of Classification Search
USPC ..... 70/14–18, 30, 49, 58, 233
See application file for complete search history.

(56) References Cited

U.S. PATENT DOCUMENTS

| | | | | | |
|---|---|---|---|---|---|
| 539,650 | A * | 5/1895 | Searle | 70/16 |
| 732,417 | A * | 6/1903 | Judd | 70/16 |
| 1,331,778 | A * | 2/1920 | Michell | 70/49 |
| 1,475,256 | A * | 11/1923 | Belair | 70/18 |
| 1,512,589 | A * | 10/1924 | Freysinger | 70/39 |
| 1,660,040 | A * | 2/1928 | Lehtonen | 24/134 KB |
| 2,190,661 | A * | 2/1940 | Hauer | 70/49 |
| 3,875,771 | A * | 4/1975 | Reisner | 70/18 |
| 4,138,867 | A * | 2/1979 | Tompkins | 70/16 |
| 5,473,917 | A * | 12/1995 | Say | 70/49 |
| 5,791,170 | A * | 8/1998 | Officer | 70/49 |
| 6,044,669 | A * | 4/2000 | Levi | 70/18 |
| 6,526,785 | B1 * | 3/2003 | Asenstorfer et al. | 70/49 |
| 6,609,399 | B1 * | 8/2003 | Daniels, Jr. | 70/49 |
| 6,629,440 | B1 | 10/2003 | Meekma et al. | |
| 6,755,054 | B2 | 6/2004 | Burmesch et al. | |
| 7,104,093 | B2 * | 9/2006 | Ling et al. | 70/30 |
| 7,152,439 | B1 * | 12/2006 | Chang | 70/30 |
| 7,293,438 | B2 * | 11/2007 | Benda | 70/18 |
| 7,526,932 | B2 * | 5/2009 | Funtmann | 70/58 |
| 8,234,757 | B2 * | 8/2012 | Lesley | 24/68 CD |
| 2003/0046852 | A1 * | 3/2003 | Burmesch et al. | 42/70.11 |
| 2005/0092037 | A1 * | 5/2005 | Meekma et al. | 70/30 |
| 2006/0042329 | A1 * | 3/2006 | Benda | 70/18 |
| 2008/0184748 | A1 * | 8/2008 | Burmesch | 70/26 |
| 2011/0174024 | A1 * | 7/2011 | Yu | 70/58 |
| 2012/0103278 | A1 * | 5/2012 | Friedland | 119/792 |

* cited by examiner

*Primary Examiner* — Lloyd Gall
(74) *Attorney, Agent, or Firm* — Muncy, Geissler, Olds & Lowe, PLLC

(57) ABSTRACT

A lock includes a housing, a cable, a restrictor, and a lock unit. One end of the cable is fixed to the housing while the other end is detachably connected to the housing so as to selectively form an adjustable loop with the housing. The restrictor is rotatably disposed on the housing to selectively wedge together with the cable. The lock unit is disposed on the housing and can be selectively moved among a first position, a second position, and a third position. When the lock unit is moved toward the first position, the restrictor moves together with the lock unit to detach from the cable so as to allow the other end of the cable to disassemble from the housing. When the lock unit is moved to the second position, the restrictor restricts the cable to move toward a specific direction so as to shrink the adjustable loop. When the lock unit is moved to the third position, the restrictor wedges together with the cable, so that the length of the adjustable loop is fixed and not adjustable.

23 Claims, 12 Drawing Sheets

LOCK

This application claims priority based on the Chinese Patent Application No. 200910166477.6, filed on Aug. 19, 2009, the disclosure of which is incorporated herein by reference in its entirety.

BACKGROUND OF THE INVENTION

1. Field of the Invention

The present invention relates to a lock; particularly, the present invention relates to a lock which secures objects through adjusting a cable.

2. Description of the Related Art

With the expansion in usage and the progress in manufacturing techniques, the forms and manufacturing methods of locks have changed, corresponding to the demands of the development of human civilization. Recently, because moveable apparatuses such as vehicles are commonly used, locks have been developed for purposes such as burglarproofing or securing moveable apparatus.

As to vehicles such as bicycles, motorcycles, or other kinds of moveable apparatuses, they are generally fixed to fixed or immoveable objects such as pillars. Consequently, a lock with better flexibility is required to connect and secure the vehicle and pillar together more conveniently. As a result, a lock with a cable is developed. The cable of a cable lock can be curved or wound around a pillar according to demands, or extended/shortened by requirement so as to fix the vehicle to the pillar conveniently and firmly.

However, in current designs, the design of this kind of cable lock has disadvantages such as lacking in rigidness or being complex in structure.

SUMMARY OF THE INVENTION

It is an objective of the present invention to provide a lock so as to avoid the above-mentioned problems, so that the lock has a simpler and firmer structure.

The lock of the present invention includes a housing, a cable, a restrictor, and a lock unit. One end of the cable is fixed to the housing while the other end is detachably connected to the housing so as to selectively form an adjustable loop with the housing. The restrictor is rotatably disposed on the housing to selectively wedge together with the cable. The lock unit is disposed on the housing and can be selectively moved among a first position, a second position, and a third position. When the lock unit is moved to the first position, the restrictor moves together with the lock unit to leave the cable so as to allow the other end of the cable to detach from the housing. When the lock unit is moved to the second position, the restrictor restricts the cable to move toward a specific direction, so as to shrink the adjustable loop. When the lock unit is moved to the third position, the restrictor wedges with the cable, so that the length of the adjustable loop is fixed and not adjustable.

DETAILED DESCRIPTION OF THE PREFERRED EMBODIMENT

The present invention provides a lock, especially an adjustable cable lock. In a preferred embodiment, the lock of the present invention utilizes an adjustable cable to secure various kinds of moveable apparatuses such as bicycles, motorcycles or other vehicles to fixed, immoveable objects such as pillars.

Figure 1A:
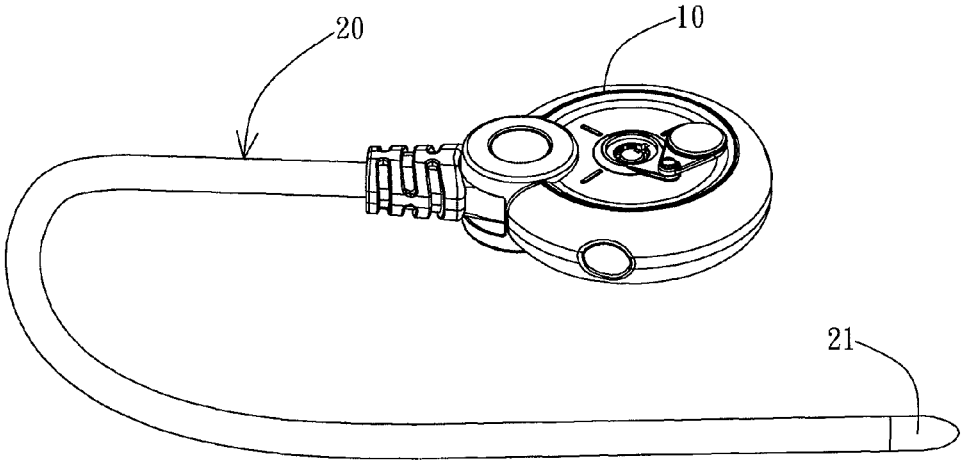
FIG. 1A is a schematic view of the exterior of an embodiment of the lock of the present invention.
Figure 1B:
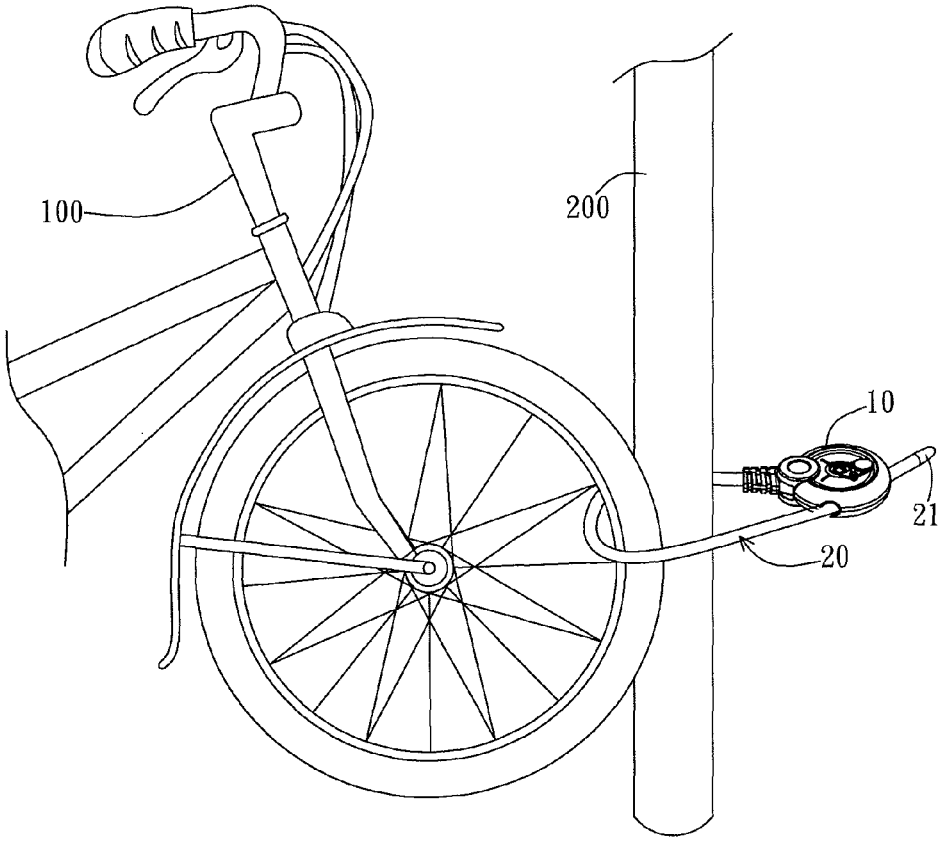
FIG. 1B is a schematic view of an embodiment of using the cable lock of the present invention.

FIG. 1A is a schematic view of the exterior of an embodiment of the lock of the present invention. As shown in FIG. 1A, the lock includes a housing 10 and a cable 20. In this embodiment, the housing 10 has an oblate shape. However, in other embodiments, the housing can have a different shape. The cable 20 is a flexible long narrow strip of which one end is fixed to the housing 10 while the other end which is a free end 21 can be connected to the housing 10 or disassembled therefrom. FIG. 1B is a schematic view of an embodiment of using the cable lock of the present invention. As shown in FIG. 1B, an object 100 can be secured to a pillar 200 through connecting the free end 21 of the cable 20 to the housing 10 so that the housing 10 and the cable 20 form a loop to enclose the object 100 and the pillar 200 therein. However, in other embodiments, the lock can be used in other ways. In a preferred embodiment, the housing 10 can be made of firm materials such as plastic or metal while the cable 20 can be made of flexible materials such as plastic, metal, or both.

Figure 2A:
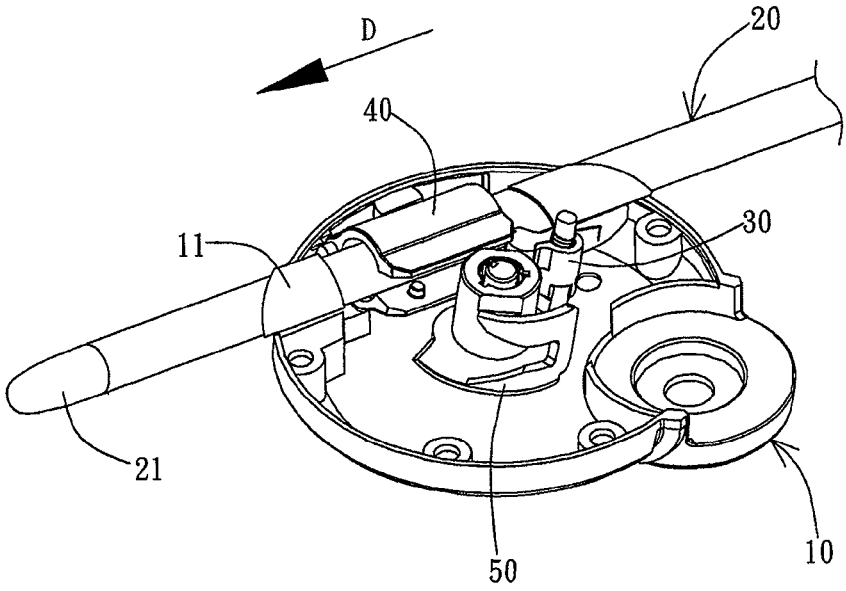
FIG. 2A is a schematic view of the first embodiment of the lock of the present invention.

FIG. 2A is a schematic view of the first embodiment of the lock of the present invention. As shown in FIG. 2A, the lock includes a housing 10, a cable 20, a restrictor 30, a fixing clip 40, and a lock unit 50. In this embodiment, the housing 10 is hollow and has an oblate shape while the restrictor 30, the fixing clip 40, and the lock unit 50 are all disposed therein. However, in other embodiments, the housing can have a different shape while the restrictor, the fixing clip, and the lock unit are not necessary to be disposed therein (e.g., exposing a portion or the entirety of the restrictor, the fixing clip, and the lock unit). Furthermore, the housing 10 can have at least a positioning portion 11 for defining the position of the free end 21 of the cable 20 on the housing 10. In this embodiment, the positioning portion 11 can be a ring with a through hole and the two positioning portions 11 are respectively disposed on the opposite sides of the housing 10. The free end 21 of the cable 20 is connected and fixed to the housing 10 through the through hole of the positioning portion 11, so that the housing 10 and the cable 20 jointly form a loop.

Figure 2B:
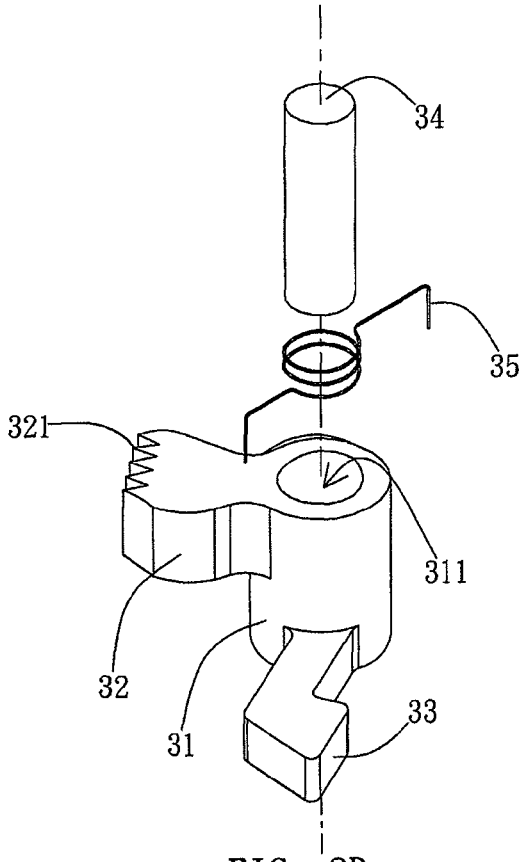
FIG. 2B is an exploded view of the restrictor of the lock shown in FIG. 2A.

As shown in FIG. 2A, the restrictor 30 is disposed beside the cable 20. FIG. 2B is an exploded view of the restrictor of the lock shown in FIG. 2A. As shown in FIG. 2B, the restrictor 30 includes a body 31, a restricting portion 32, a wedging portion 33, a bolt 34, and a torsional spring 35. In this embodiment, the body 31 has an axial hole 311. The body 31 connects to the housing 10 by inserting the bolt 34 into the axial hole 311, and the body 31 can rotate around the bolt 34. However, in other embodiments, the bolt can be formed as a portion of the housing. The restricting portion 32 and the wedging portion 33 are respectively disposed on the upper end and lower end of the body 31. An angle is formed between the restricting portion 32 and the projection of the wedging portion 33 on a same virtual plane perpendicular to the axial hole, and the angle is smaller than 180 degrees. One end of the restrictor 32 has a sawtoothed portion 321 with sawteeth formed along the direction of D. The wedging portion 33 is a protruding arm corresponding to the lock unit 50. The torsional spring 35 is disposed on the body 31 to urge the restrictor 30 to rotate toward the cable 20.

Figure 2C:
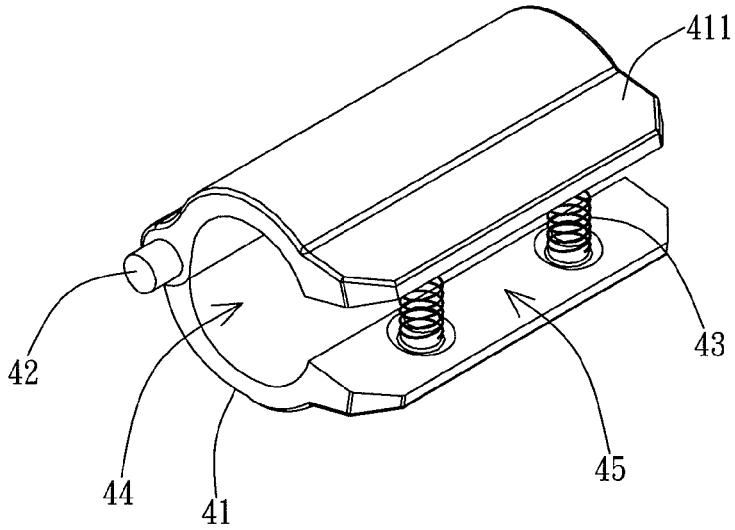
FIG. 2C is a schematic view of the fixing clip of the lock shown in FIG. 2A.

As shown in FIG. 2A, the fixing clip 40 is disposed between the two positioning portions 11. The fixing clip 40 and the lock unit 50 face each other. FIG. 2C is a schematic view of the fixing clip of the lock shown in FIG. 2A. As shown in FIG. 2C, the fixing clip 40 includes clamping slices 41, a bolt 42, and springs 43. One side of the clamping slice 41 includes a lip portion 411 while the other side connects to the other of the clamping slices 41 through the bolt 42 so that the two clamping slices 41 are disposed corresponding to each other. Springs 43 are disposed between the two lip portions 411 to provide a force to prop apart the two clamping slices 41 so as to form a channel 44 which the cable 20 connected to the housing 10 can pass therethrough. An opening 45 is located beside the channel 44 so that the channel 44 has an open ring-shaped cross-section. However, in other embodiments, different structures can be utilized to form the channel and the opening. For instance, the channel can be formed by curving monolithic flexible materials such as metal or plastic. Furthermore, the cross-section can be U-shaped or other shapes.

Figure 2D:
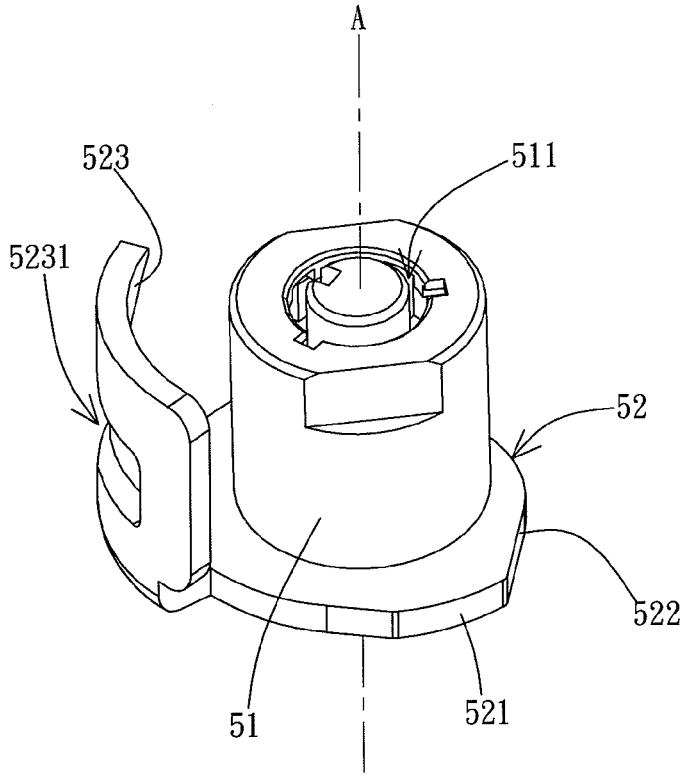
FIG. 2D is a schematic view of the lock unit of the lock shown in FIG. 2A.

FIG. 2D is a schematic view of the lock unit of the lock shown in FIG. 2A. As shown in FIG. 2D, the lock unit 50 includes a lock body 51 and a discoidal body 52. The lock body 51 has a lockhole 511 for a key to insert therein so as to enable the lock body 51 to move among a first position, a second position, and a third position. The discoidal body 52 connects to the lock body 51 and rotates around the rotation center A with the movement of the lock body 51. The discoidal body 52 has an unlocking portion 521, a releasing portion 522, and a clamping portion 523. The unlocking portion 521 is an arc-shaped portion of the rim of the discoidal body 52. The distance between the unlocking portion 521 and the rotation center A is larger than the distance between the releasing portion 522 and the rotation center A, i.e., the radial distance of the unlocking portion 521 with respect to the rotation center A is larger than the radial distance of the releasing portion 522 with respect to the rotation center A. The clamping portion 523 is disposed on the rim of the discoidal body 52, so that the distance between the clamping portion 523 and the rotation center A is larger than the distance between the releasing portion 522 and the rotation center A and the distance between the unlocking portion 521 and the rotation center A. That is, the clamping portion 523 is the one that has the largest radial distance with respect to the rotation center A among the unlocking portion 521, the releasing portion 522, and the clamping portion 523. The clamping portion 523 protrudes perpendicularly from the discoidal body 52 and has a clamping channel 5231 formed on one side, so that the width of the clamping channel 5231 gradually shrinks from its opening to its interior.

Figure 3A:
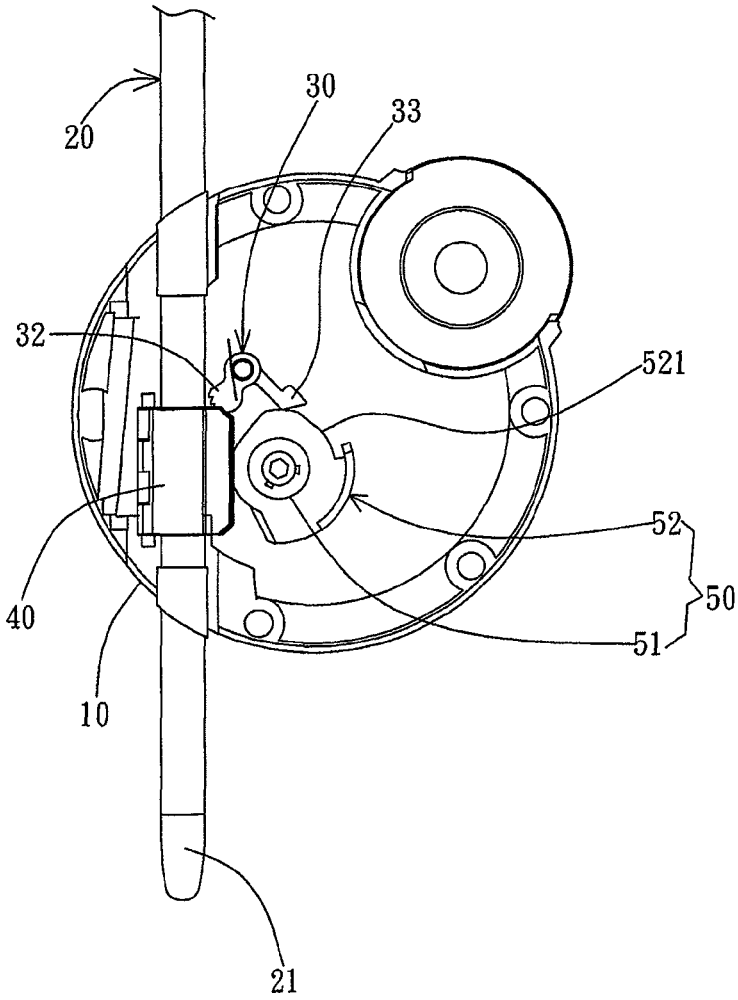
FIG. 3A is a schematic view of an embodiment of the lock shown in FIG. 2A in the first position.
Figure 3B:
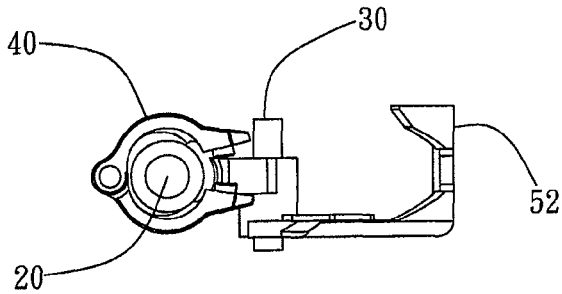
FIG. 3B is a schematic view of the lock shown in FIG. 3A from another angle.

FIG. 3A is a schematic view of an embodiment of the lock shown in FIG. 2A in the first position; FIG. 3B is a schematic view of the lock shown in FIG. 3A from another angle. As shown in FIG. 3A and FIG. 3B, when the lock body 51 is moved toward the first position, the unlocking portion 521 of the discoidal body 52 contacts the restrictor 30 and gradually enables the restrictor 30 to leave the cable 20 by rotating with the discoidal body 52, i.e., the rim portion of the discoidal body 52, which has a larger radial distance, is utilized to contact the wedging portion 33 so as to enable the restrictor 32 to leave the cable 20 accordingly, so that the free end 21 of the cable 20 can be detached from the housing 10.

Figure 4A:
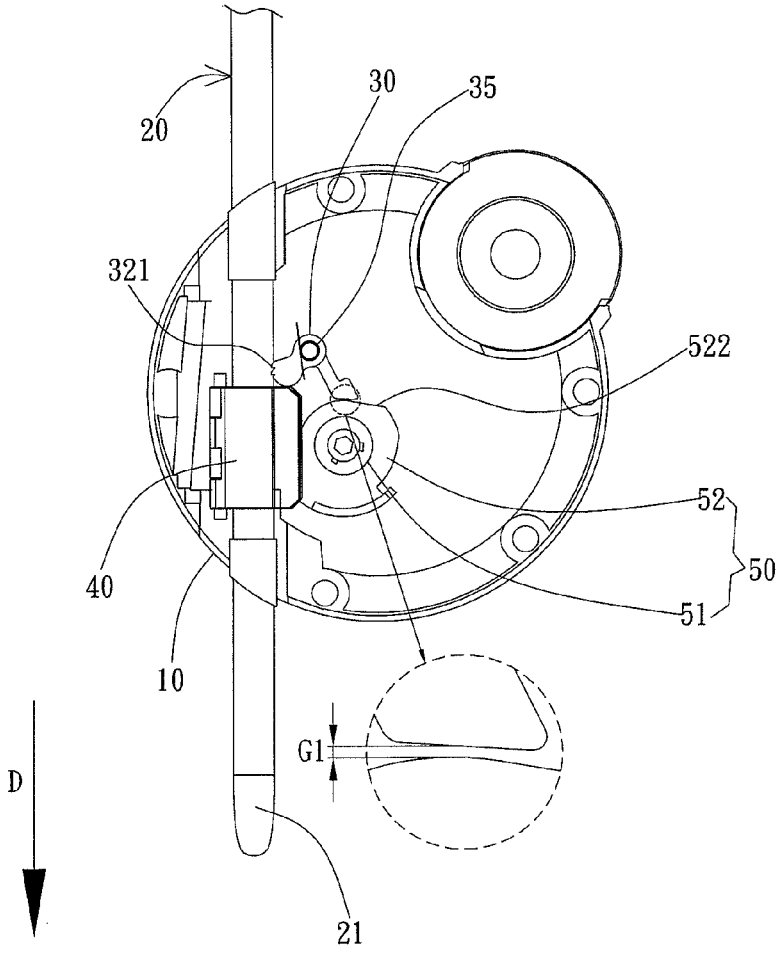
FIG. 4A is a schematic view of an embodiment of the lock shown in FIG. 2A in the second position.
Figure 4B:
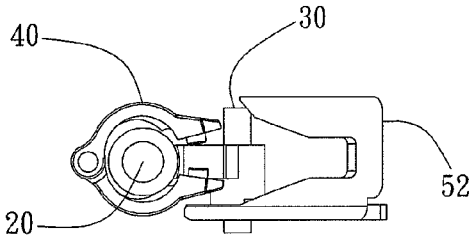
FIG. 4B is a schematic view of the lock shown in FIG. 4A from another angle.

FIG. 4A is a schematic view of an embodiment of the lock shown in FIG. 2A in the second position; FIG. 4B is a schematic view of the lock shown in FIG. 4A from another angle. As shown in FIG. 4A and FIG. 4B, when the lock body 51 is moved to the second position, the releasing portion 522 of the discoidal body 52 faces the restrictor 30 and keeps a distance G1 therebetween to allow the restrictor 30 to move toward the cable 20. In the preferred embodiment, the rotating direction of the discoidal body 52 is the same as that of the restrictor 30 (e.g., both clockwise or counter-clockwise), and the torsional spring 35 of the restrictor 30 urges the restrictor 30 to rotate toward the cable 20. However, in other embodiments, the rotating direction of the discoidal body can be different from that of the restrictor, and other methods can be employed to cause the restrictor to rotate toward the cable. Since the sawtoothed portion 321 contacts the cable 20 while the sawtoothed portion 321 of the restrictor 30 has sawteeth formed toward direction D, the cable 20 can only move along the sawteeth formation trend D to shrink the loop formed by the housing 10 and the cable 20.

Figure 5A:
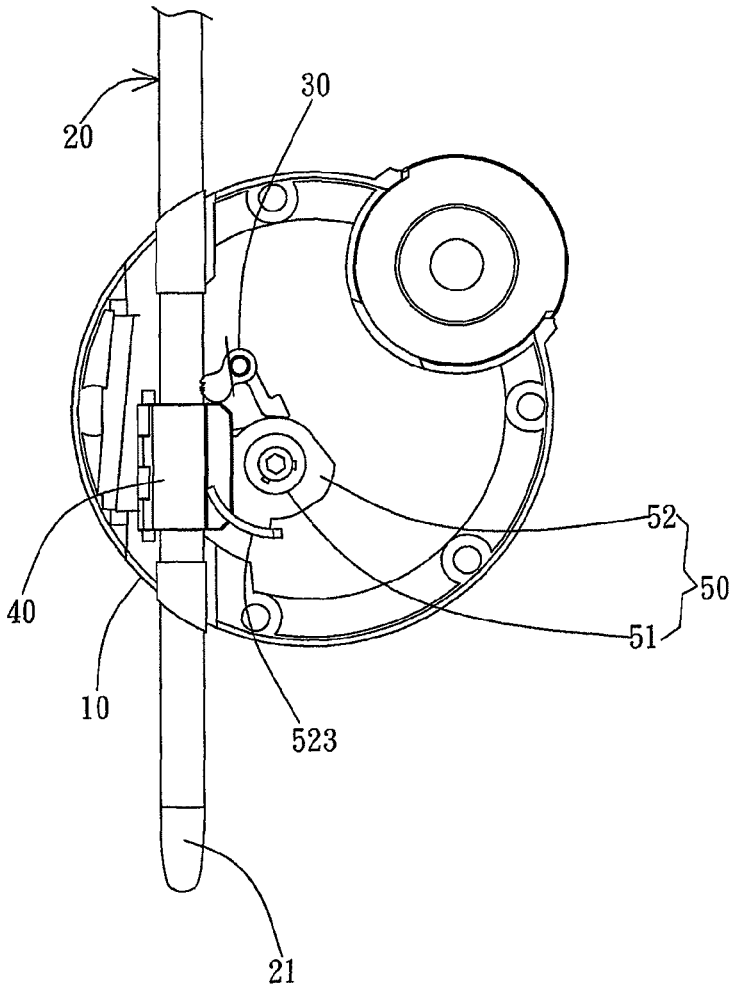
FIG. 5A is a schematic view of an embodiment of the lock shown in FIG. 2A in the third position.
Figure 5B:
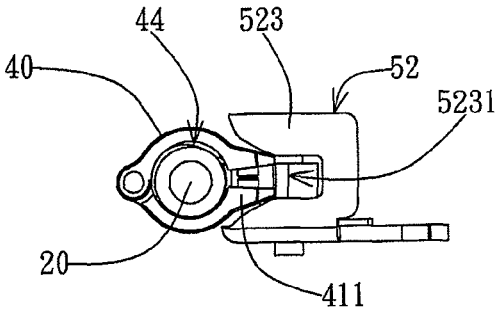
FIG. 5B is a schematic view of the lock shown in FIG. 5A from another angle.

FIG. 5A is a schematic view of an embodiment of the lock shown in FIG. 2A in the third position; FIG. 5B is a schematic view of the lock shown in FIG. 5A from another angle. As shown in FIG. 5A and FIG. 5B, when the lock body 51 is moved from the second position toward the third position, the clamping portion 523 of the discoidal body 52 moves toward the fixing clip 40 correspondingly to enable the clamping channel 5231 to accommodate the lip portion 411 of the fixing clip 40. Since the width of the clamping channel 5231 gradually shrinks from its opening to its interior, the open ring-shaped cross-section of the channel 44 gradually closes with the increasing depth of the fixing clip 40 in the clamping channel 5231. Consequently, when the lock unit 51 is moved toward the third position, the clamping portion 523 gradually pushes the fixing clip 40 as the discoidal body 52 rotates, so that the open ring-shaped cross-section of the channel 44 deforms to restrict the movement of the cable 20 in the channel 44, and then the length of the loop formed by the housing 10 and the cable 20 is fixed and not adjustable.

Figure 6A:
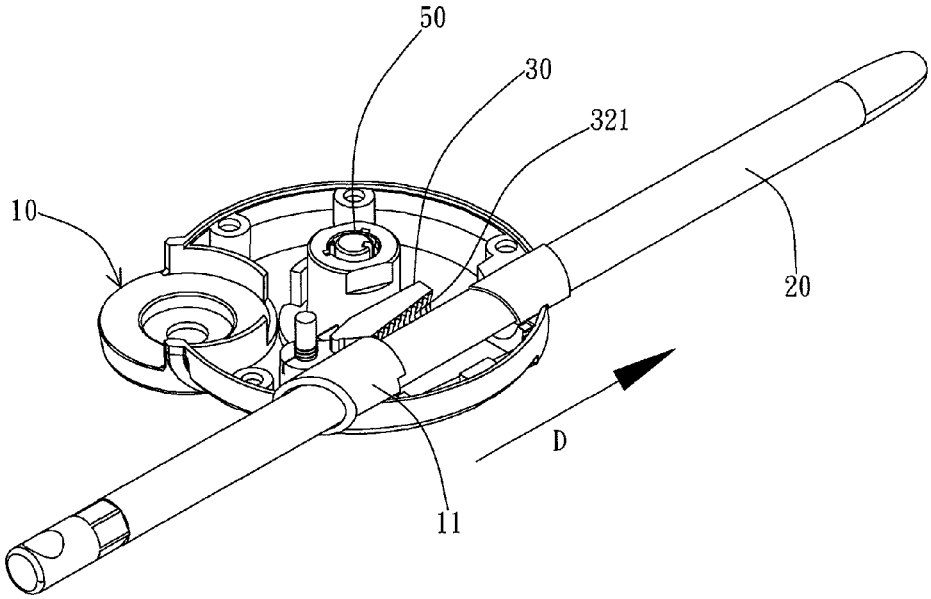
FIG. 6A is a schematic view of the second embodiment of the lock of the present invention.

FIG. 6A is a schematic view of the second embodiment of the lock of the present invention. As shown in FIG. 6A, the lock of the present invention includes a housing 10, a cable 20, a restrictor 30, and a lock unit 50. In this embodiment, the housing 10 is hollow and has an oblate shape while the restrictor 30 and the lock unit 50 are both disposed therein. However, in other embodiments, the housing can have a different shape while the restrictor and the lock unit are not necessary disposed therein (e.g., exposing a portion or entirety of the restrictor and the lock unit). Furthermore, the housing 10 can have at least a positioning portion 11 for defining the position of the free end 21 of the cable 20 on the housing 10. In this embodiment, the positioning portion 11 is a ring with a through hole and the two positioning portions 11 are respectively disposed on opposite sides of the housing 10. The free end 21 of the cable 20 is connected and fixed to the housing 10 through the through hole of the positioning portion 11, so that the housing 10 and the cable 20 jointly form a loop.

Figure 6B:
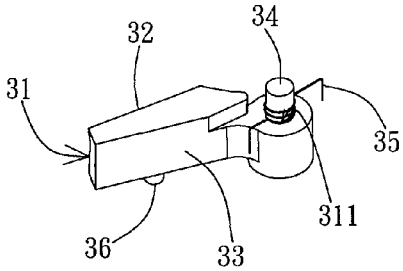
FIG. 6B is a schematic view of the restrictor of the lock shown in FIG. 6A.

As shown in FIG. 6A, the restrictor 30 is disposed beside the cable 20. FIG. 6B is a schematic view of the restrictor of the lock shown in FIG. 6A. As shown in FIG. 6B, the restrictor 30 includes a body 31, a restricting portion 32 a wedging portion 33, a bolt 34, a torsional spring 35, and a protruding portion 36. In this embodiment, the body 31 has an axial hole 311. The body 31 connects to the housing 10 by inserting the bolt 34 into the axial hole 311, and the body 31 can rotate around the bolt 34. However, in other embodiments, the bolt can be formed as a portion of the housing. In this embodiment, the restricting portion 32 and the wedging portion 33 are respectively disposed on opposite sides of the body 31. An angle is formed between the restricting portion 32 and the wedging portion 33, i.e., the restricting portion 32 and the wedging portion 33 are not parallel to each other. The restrictor 32 has a sawtoothed portion 321 formed on the surface of the restricting portion 32, with the sawtoothed portion 321 having sawteeth toward the direction of D. The torsional spring 35 is disposed on the body 31 to urge the restrictor 30 to rotate toward the cable 20. The protruding portion 36 is a protrusion formed on one side of the body 31.

Figure 6C:
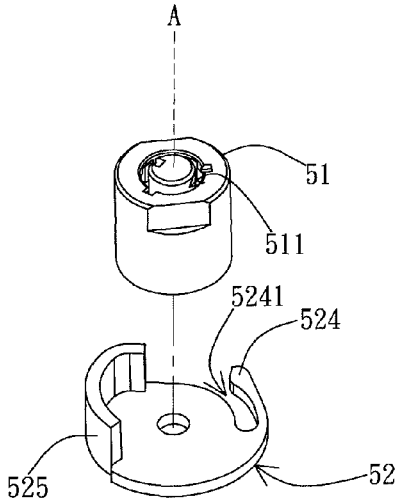
FIG. 6C is an exploded view of the lock unit of the lock shown in FIG. 6A.

FIG. 6C is an exploded view of the lock unit of the lock shown in FIG. 6A. As shown in FIG. 6C, the lock unit 50 includes a lock body 51 and a discoidal body 52. The lock body 51 has a lockhole 511 for a key to insert therein so as to enable the lock body 51 to move among a first position, a second position, and a third position. The discoidal body 52 connects to the lock body 51 and rotates around the rotation center A with the movement of the lock body 51. The discoidal body 52 has a protruding arm 524 and a pressing portion 525. The protruding arm 524 horizontally protrudes from the rim of the discoidal body 52 to form a chute 5241 between the protruding arm 524 and the rim of the discoidal body 52 while the pressing portion 525 vertically protrudes from the rim of the discoidal body 52. In this embodiment, the pressing portion 525 forms an arc-shaped protruding wall.

Figure 7A:
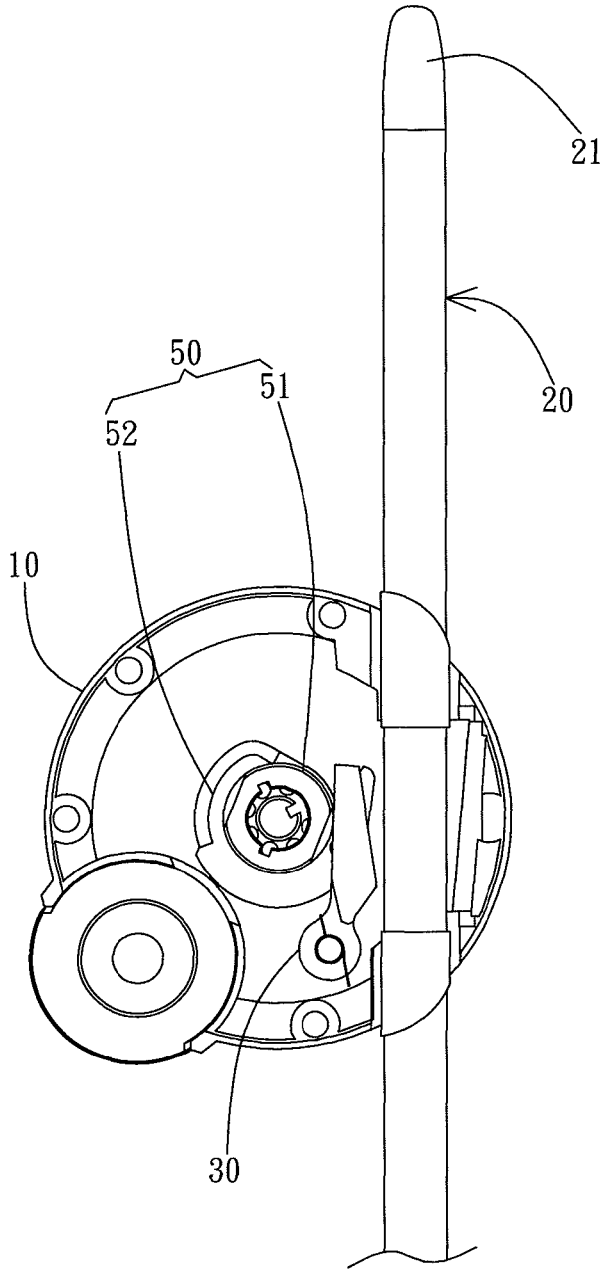
FIG. 7A is a schematic view of an embodiment of the lock shown in FIG. 6A in the first position.
Figure 7B:
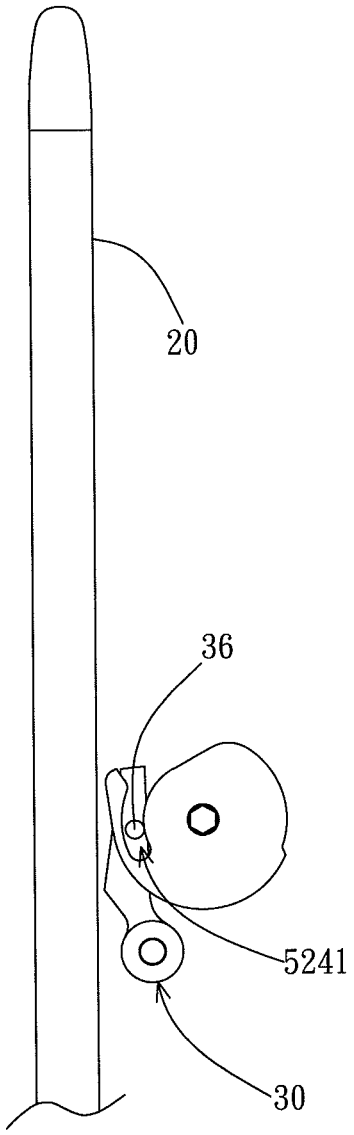
FIG. 7B is a schematic view of the lock shown in FIG. 7A from another angle.

FIG. 7A is a schematic view of an embodiment of the lock shown in FIG. 6A in the first position; FIG. 7B is a schematic view of the lock shown in FIG. 7A from another angle. As shown in FIG. 7A and FIG. 7B, when the lock body 51 is moved toward the first position, the protruding portion 36 wedges in the chute 5241 and slides along the chute 5241 to enable the restrictor 30 to gradually leave the cable 20 through rotating with the discoidal body 52, so that the free end 21 of the cable 20 can be disassembled from the housing 10.

Figure 8A:
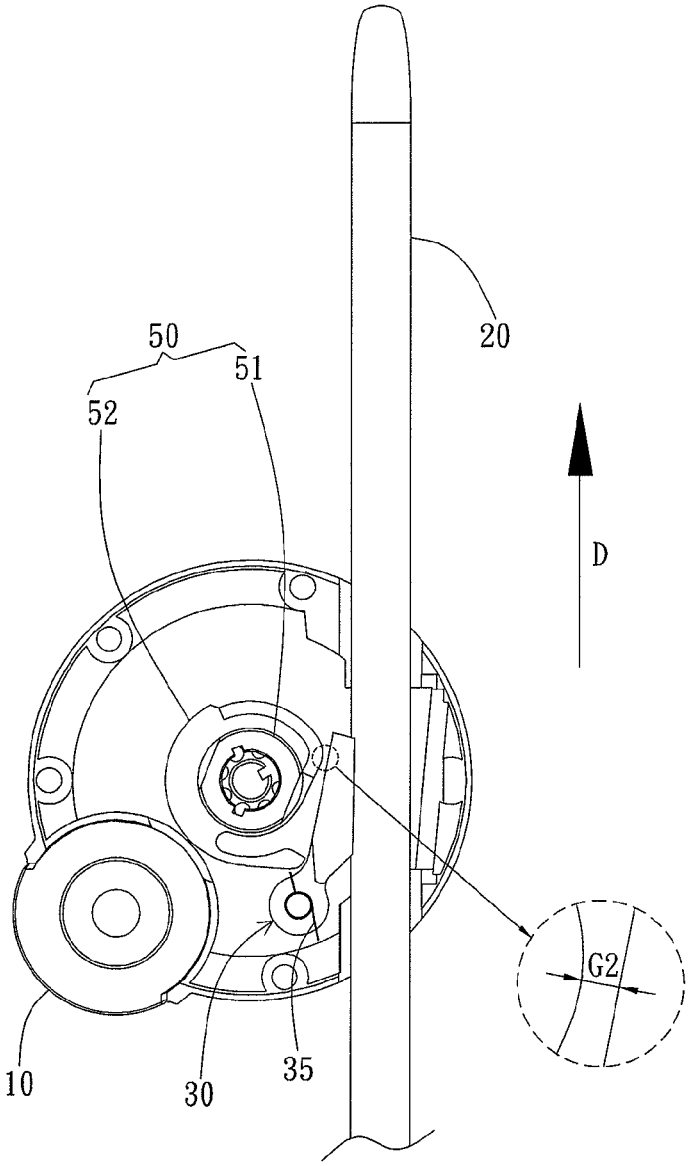
FIG. 8A is a schematic view of an embodiment of the lock shown in FIG. 6A in the second position.
Figure 8B:
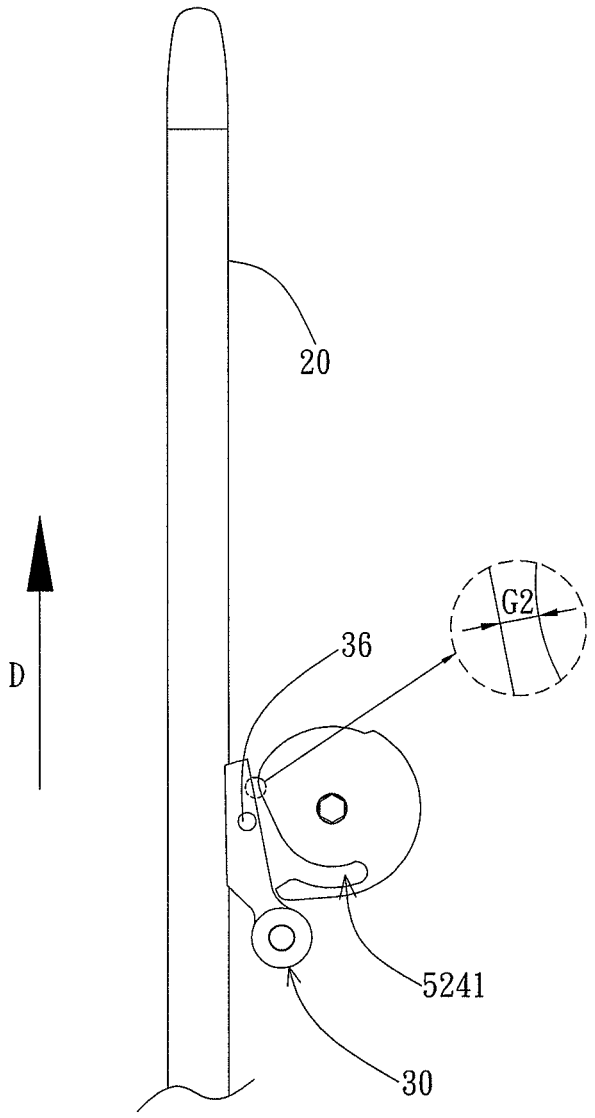
FIG. 8B is a schematic view of the lock shown in FIG. 8A from another angle.

FIG. 8A is a schematic view of an embodiment of the lock shown in FIG. 6A in the second position; FIG. 8B is a schematic view of the lock shown in FIG. 8A from another angle. As shown in FIG. 8A and FIG. 8B, when the lock body 51 is moved toward the second position, the protruding portion 36 slides along and then leaves the chute 5241, so that the discoidal body 52 releases the restrictor 30 to allow the restrictor 30 to rotate. In the preferred embodiment, the rotating direction of the discoidal body 52 is the same as that of the restrictor 30 (e.g., both clockwise or counter-clockwise), and the torsional spring 35 of the restrictor 30 urges the restrictor 30 to rotate toward the cable 20. However, in other embodiments, the rotating direction of the discoidal body can be different from that of the restrictor, and other methods can be employed to cause the restrictor to rotate toward the cable. Since the sawtoothed portion 321 contacts the cable 20 while the sawtoothed portion 321 of the restrictor 30 has sawteeth moving toward the direction D, the cable 20 can only move along the sawteeth toward the direction D to shrink the loop formed by the housing 10 and the cable 20. Furthermore, a distance G2 is maintained between the restrictor 30 and the discoidal body 52 so that when the cable 20 is moved toward the direction D, the restrictor 30 swings toward the direction of the discoidal body 52 with the movement of the cable 20, and consequently the movement of the cable 20 toward the direction D will not be obstructed.

Figure 9:
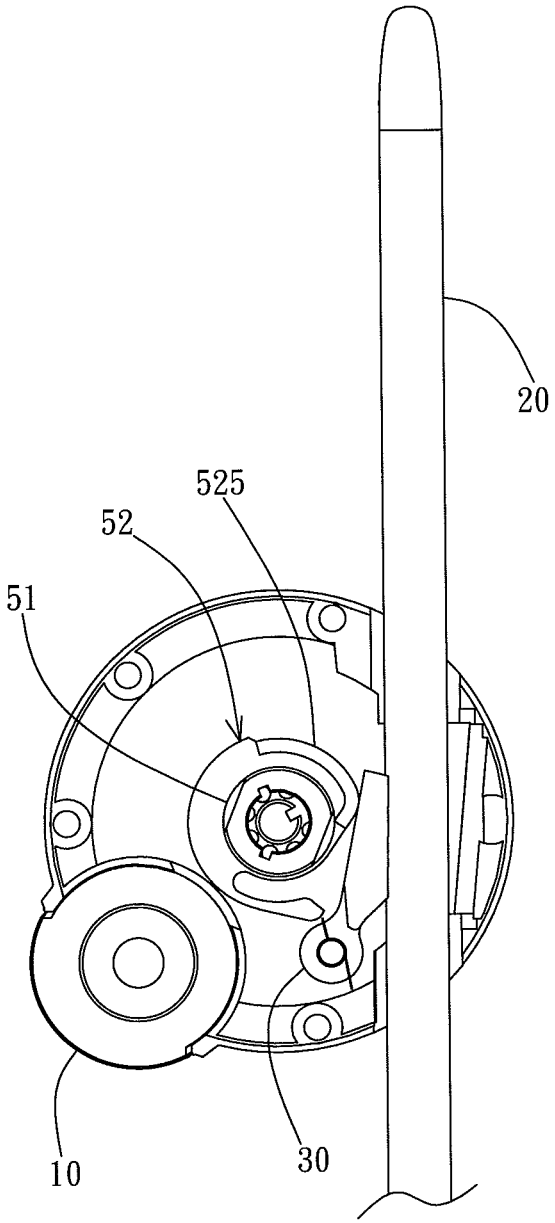
FIG. 9 is a schematic view of an embodiment of the lock shown in FIG. 6A in the third position.

FIG. 9 is a schematic view of an embodiment of the lock shown in FIG. 6A in the third position. As shown in FIG. 9, when the lock unit 51 is moved toward the third position, the pressing portion 525 pushes the restrictor 30 toward the direction of the cable 20 to enable the restrictor 30 to restrict the movement of the cable 20, so that the length of the loop formed by the housing 10 and the cable 20 is fixed and not adjustable.

Although the present invention has been described through the above-mentioned related embodiments, the above-mentioned embodiments are merely examples for practicing the present invention. What needs to be indicated is that the disclosed embodiments are not intended to limit the scope of the present invention. On the contrary, modifications with the essence and scope of the claims and their equivalent dispositions are all contained within the scope of the present invention.

What is claimed is:

1. A lock, comprising:

a housing;

a cable with one end fixed to the housing and the other end detachably connected to the housing, so that an adjustable loop is selectively formed by the cable and the housing;

a restrictor rotatably disposed on the housing to selectively wedge with the cable; and a lock unit disposed on the housing, the lock unit being selectively moved among a first position, a second position, and a third position;

wherein when the lock unit is moved toward the first position, the restrictor moves along with the lock unit to leave the cable so as to allow the other end of the cable to detach from the housing;

when the lock unit is moved to the second position, the lock unit does not contact the restrictor and enables the restrictor to restrict the cable to move toward one specific direction, so as to shrink the adjustable loop; and when the lock unit is moved to the third position, the restrictor wedges with the cable, so that the length of the adjustable loop is fixed and not adjustable.

2. The lock of claim 1, wherein the housing has at least a positioning portion for defining the position of the other end of the cable on the housing.

3. The lock of claim 1, wherein the lock unit has a lock body and a discoidal body, the lock body has a lockhole for a key to insert therein so as to enable the lock unit to move among the first position, the second position, and the third position, the discoidal body connects to the lock body and moves along with the lock body.

4. The lock of claim 3, wherein the discoidal body has an axis and a plurality of rim portions, each of the plurality of the rim portions has a different radial distance with respect to the axis.

5. The lock of claim 4, wherein the restrictor includes a body, a restricting portion, and a wedging portion, the body has an axial hole, the body rotatably connects to the housing through the axial hole, the restricting portion and the wedging portion are disposed on two sides of the body.

6. The lock of claim 5, wherein when the lock unit is moved toward the first position, the discoidal body is rotated accordingly so that the rim portion of the discoidal body having a longer radial distance contacts the wedging portion to enable the restricting portion to leave the cable.

7. The lock of claim 6, wherein when the lock unit is moved from the first position to the second position, the discoidal body rotates correspondingly so that the rim portion of the discoidal body having a shorter radial distance faces the wedging portion while a distance is maintained therebetween.

8. The lock of claim 3, wherein the restrictor further includes a fixing clip, the fixing clip has a channel, wherein the channel has a cross-section so as to allow the other end of the cable to insert therein.

9. The lock of claim 8, wherein the lock unit further includes a clamping portion disposed on a rim portion of the discoidal body having a largest radial distance, the clamping portion has a clamping channel, when the lock unit is moved from the second position toward the third position, the clamping portion moves toward the fixing clip correspondingly to enable the clamping channel to accommodate a portion of the fixing clip.

10. The lock of claim 8, wherein the fixing clip includes at least a clamping slice, the clamping slice is curved to form the channel.

11. The lock of claim 3, wherein the discoidal body has a protruding arm horizontally protruding from a rim of the discoidal body to form a chute, the restrictor has a protruding portion, when the lock unit is moved to the first position, the protruding portion wedges in the chute and slides along the chute to a predetermined position to enable the restrictor to leave the cable; when the lock unit is moved to the second position, the protruding portion slides along the chute to leave therefrom, so that the discoidal body releases the restrictor to allow the restrictor to rotate.

12. The lock of claim 11, wherein the discoidal body further includes a pushing portion vertically protruding from the rim of the discoidal body, when the lock unit is moved to the third portion, the pushing portion pushes the restrictor toward the direction of the cable.

13. The lock of claim 1, wherein the restrictor further includes a sawtoothed portion, sawteeth of the sawtoothed portion are formed leaning toward the one specific direction, when the lock unit is moved to the second position, the sawtoothed portion contacts the cable so that the cable can only move along the sawteeth of the sawtoothed portion.

14. The lock of claim 1, wherein the restrictor further includes a torsional spring, when the lock unit is moved to the second position, the torsional spring urges the restrictor to rotate toward the cable.

15. A lock, comprising:

a housing;

a cable with one end fixed to the housing and the other end detachably connected to the housing;

a restrictor disposed beside one end of the cable;

a fixing clip disposed on the housing, the fixing clip having a channel, the channel having an open ring-shaped cross-section to allow the other end of the cable to insert therein; and a lock unit disposed on the housing, the lock unit including a lock body and a discoidal body, the lock body being selectively moved among a first position, a second position, and a third position, wherein the discoidal body connects to the lock body and rotates with the movement of the lock body, the discoidal body has an unlocking portion, a releasing portion, and a clamping portion with the unlocking portion, the releasing portion, and the clamping portion being different rim portions of the discoidal body, the discoidal body has a rotation center, the distance between the unlocking portion and the rotation center is larger than the distance between the releasing portion and the rotation center, wherein:

when the lock body is moved toward the first position, the unlocking portion contacts the restrictor and gradually enables the restrictor to leave the cable by rotating with the discoidal body, so that the other end of the cable is detachable from the housing;

when the lock body is moved to the second position, the releasing portion faces the restrictor and maintains a distance therebetween to allow the restrictor to move toward the cable so as to restrict the cable to move toward one specific direction; and when the lock unit is moved toward the third position, the clamping portion gradually pushes the fixing clip as the discoidal body rotates, so that the open ring-shaped cross-section of the channel deforms to restrict the movement of the cable.

16. The lock of claim 15, wherein the restrictor includes a body, a restricting portion, a wedging portion, and a bolt, the body has an axial hole, the body rotatably connects to the housing by inserting the bolt into the axial hole; the restricting portion and the wedging portion are disposed on two sides of the body while a projection of the restricting portion and a projection of the wedging portion on a same virtual plane perpendicular to the axial hole have an angle therebetween; the restrictor has a sawtoothed portion, sawteeth of the sawtoothed portion formed leaning toward the one specific direction, when the lock body is moved to the second position, the sawtoothed portion contacts the cable so that the cable can only move along the sawteeth.

17. The lock of claim 16, wherein when the lock body is moved to the first position, the discoidal body rotates correspondingly to enable the unlocking portion to contact the wedging portion, so that the restrictor leaves the cable accordingly; when the lock body is moved from the first position toward the second position, the discoidal body rotates correspondingly so that the releasing portion faces the wedging portion and maintains a distance therebetween.

18. The lock of claim 17, wherein the clamping portion is disposed on a rim of the discoidal body so that the distance between the clamping portion and the rotation center is larger than the distance between the releasing portion and the rotation center and the distance between the unlocking portion and the rotation center, the clamping portion has a clamping channel, when the lock body is moved from the second position toward the third position, the clamping portion moves toward the fixing clip correspondingly to enable the clamping channel to accommodate a portion of the fixing clip; the clamping channel has a narrowing width so that the open ring-shaped cross-section of the channel gradually closes with the increasing depth of the fixing clip in the clamping channel.

19. The lock of claim 15, wherein the fixing clip includes two clamping slices, at least a bolt, and at least a spring, the clamping slices connect to each other through the bolt, the spring is disposed between the clamping slices to provide a force to prop apart the clamping slices so as to form the channel.

20. A lock, comprising:

a housing;

a cable with one end fixed to the housing and the other end detachably connected to the housing;

a restrictor disposed beside the other end of the cable, the restrictor having a protruding portion; and a lock unit disposed on the housing, wherein the lock unit includes a lock body and a discoidal body, the lock body is selectively moved among a first position, a second position, and a third position, the discoidal body is connected to the lock body and rotates with the movement of the lock body, the discoidal body has a protruding arm and a pressing portion, the protruding arm horizontally protrudes from a rim of the discoidal body to form a chute while the pressing portion vertically protrudes from the rim of the discoidal body, wherein:

when the lock body is moved toward the first position, the protruding portion wedges in the chute and slides along the chute to a predetermined position to enable the restrictor to gradually leave the cable through rotating with the discoidal body, so that the other end of the cable is detachable from the housing;

when the lock body is moved toward the second position, the protruding portion slides along the chute to leave therefrom, so that the discoidal body releases the restrictor to allow the restrictor to rotate so as to restrict the cable to move toward a one specific direction;

when the lock unit is moved toward the third position, the pressing portion pushes the restrictor in the direction of the cable to enable the restrictor to restrict the movement of the cable.

21. The lock of claim 20, wherein the restrictor has a body, a restricting portion, a wedging portion and a bolt, the body has an axial hole, the body rotatably connects to the housing by inserting the bolt into the axial hole, the restricting portion and the wedging portion are disposed on opposite sides of the body while an angle is kept therebetween; the restrictor has a sawtoothed portion, sawteeth of the sawtoothed portion are formed toward the one specific direction, when the lock body is moved to the second postion, the sawteeth contact the cable so that the cable can only be moved along the sawteeth.

22. The lock of claim 20, wherein the pressing portion is an arc-shaped protruding wall.

23. The lock of claim 20, wherein when the lock body is moved to the second position, a distance is maintained between the restrictor and the discoidal body so that when the cable is moved toward the one specific direction, the restrictor swings toward the direction of the discoidal body with the movement of the cable so as to restrict the cable to move toward the one specific direction.

* * * * *